United States Patent [19]

Forker

[11] 3,993,430

[45] Nov. 23, 1976

[54] LIQUID FUEL FIREPLACE LOG

[75] Inventor: Richard O. Forker, Logansport, Ind.

[73] Assignee: The Raymond Lee Organization, Inc., New York, N.Y. ; a part interest

[22] Filed: Nov. 17, 1975

[21] Appl. No.: 632,389

[52] U.S. Cl. ..... 431/125; 431/331

[51] Int. Cl.[2] ..... F23Q 2/32

[58] Field of Search ..... 431/125, 126, 291, 331, 431/DIG. 18; D7/206, 207

[56] References Cited

UNITED STATES PATENTS

| | | | |
|---|---|---|---|
| 697,941 | 4/1902 | Hewitt | 431/125 |
| 2,509,690 | 5/1950 | Martin | 431/331 X |
| 3,292,608 | 12/1966 | Waddell et al. | 431/291 X |
| 3,582,250 | 6/1971 | Chatfied | 431/125 |

*Primary Examiner*—Edgar W. Geoghegan
*Attorney, Agent, or Firm*—Howard I. Podell

[57] ABSTRACT

A two piece ceramic hollow log formed with perforations in the outer walls and partially filled with noncombustible particles such as sand and vermiculite and with fuel oil which is absorbed by the particles. The log when assembled resembles a wooden fireplace log and may be employed together with wood logs as a starter of a fireplace fire, or may be employed by itself in a fireplace to provide heat and a realistic fireplace flame.

2 Claims, 3 Drawing Figures

LIQUID FUEL FIREPLACE LOG

SUMMARY OF THE INVENTION

My invention is a two piece ceramic hollow log formed with perforations in the outer walls and partially filled with non-combustible particles such as sand and vermiculite and with fuel oil which is absorbed by the particles. The log when assembled resembles a wooden fireplace log and may be employed together with wood logs as a starter of a fireplace fire, or may be employed by itself in a fireplace to provide heat and a realistic fireplace flame.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 2:
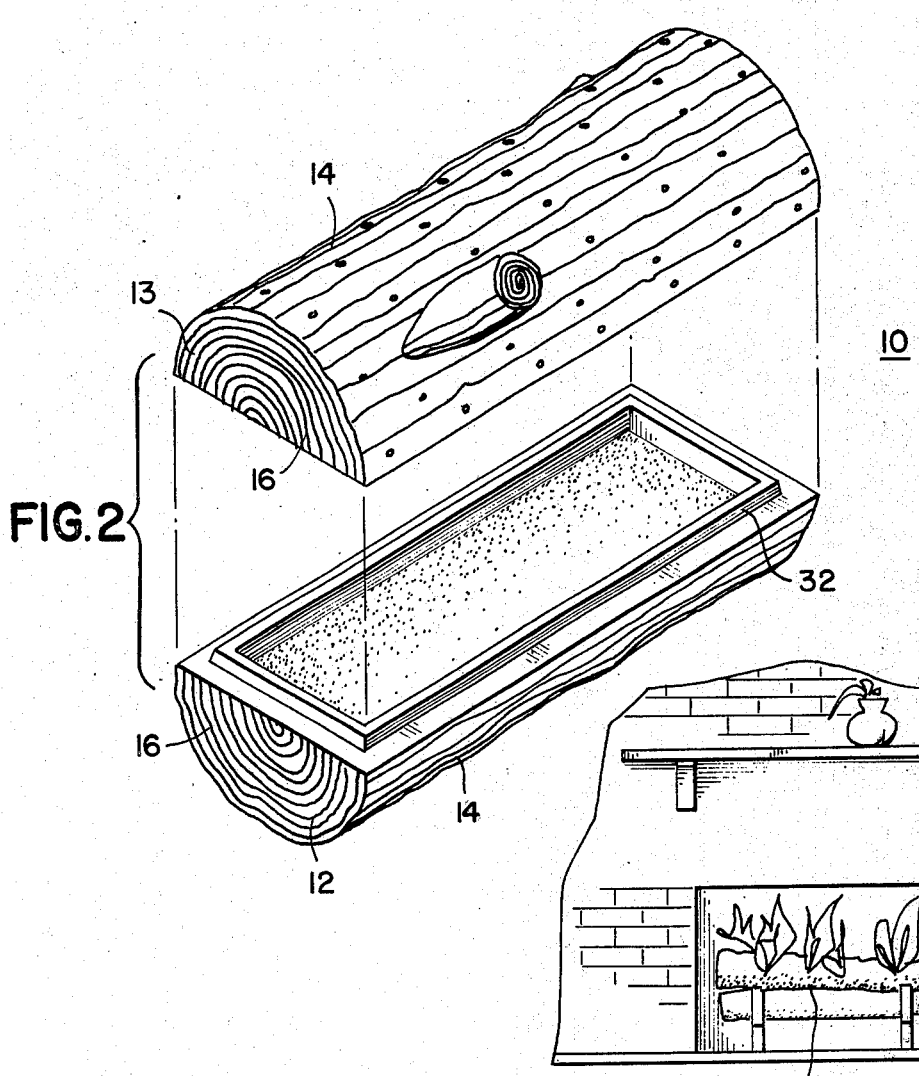
FIG. 2 is an exploded perspective view of the invention.
Figure 1:
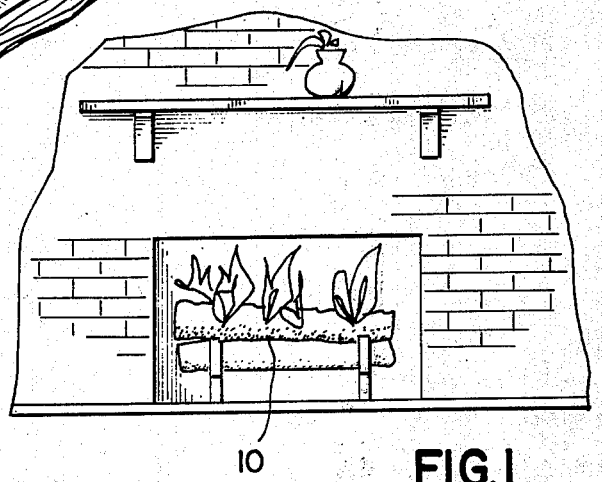
FIG. 1 is an elevation view of a fireplace using the invention.
Figure 3:
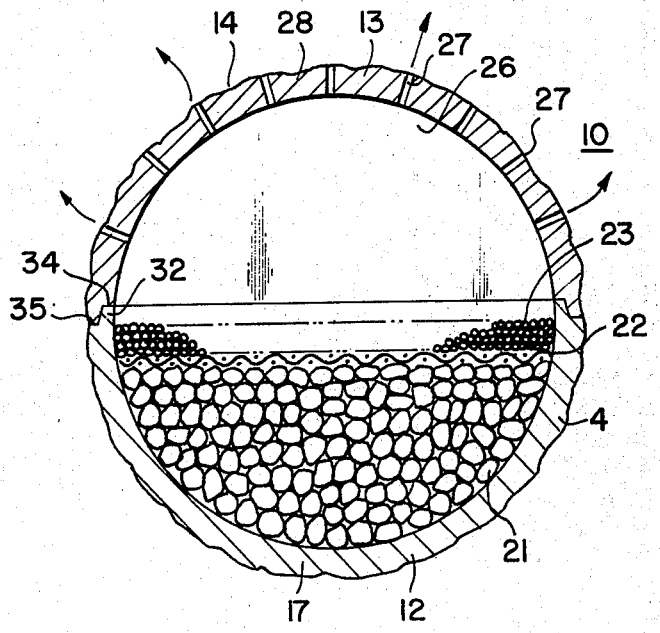
FIG. 3 is a sectional view of the invention.

Turning now descriptively to the drawings, in which similar reference characters denote similar elements throughout the several views, FIGS. 1–3 illustrate the ceramic log 10 which may be employed in a fireplace 11 together with natural logs or alone.

Ceramic log 10 is formed of two mating ceramic half sections 12 and 13 each of which is finished along its exterior surface 14 in the texture of a natural log with the shape of the assembled log 10 resembling that of a natural log.

Bottom section 12 is formed with a hollow interior section bounded by solid end walls 16 and a solid cylindrical wall 17 with the interior section filled with particles of vermiculite 21 held in place by a screen 22, with a layer of sand 23 lying on the screen 22. In use, a quantity of fuel oil is added to the interior of bottom section 12 which is absorbed by the vermiculite 21 and sand 23, and the log 10 assembled by addition of mating upper section 13.

Upper log section 13 is shaped with an interior chamber 26 with solid end walls 16 and with through perforations 27 in the cylindrical wall 28 which vent the vapor of fuel oil in the interior chamber 26.

A projecting lip 32 is formed along the open edge 33 of the bottom by section 12 to fit in a recessed section 34 bounding the open edge 35 of the upper log section 13 to provide for fitting the two sections 12 and 13 together.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A ceramic log formed of two assembled sections of ceramic material each of which section is formed with a hollow interior, with the ceramic log shaped on its exterior to resemble a natural wood log, with a first section, which serves as the bottom of the assembled log in use, fitted with particles of non-combustible matter, and the second section, which serves as the top of the assembled log in use formed with vent holes in the walls of the said section leading from the interior chamber.

2. The combination as recited in claim 1 together with a quantity of liquid fuel added to the interior of the bottom of the assembled log.

* * * * *